US006120094A

United States Patent [19]

Parent

[11] Patent Number: 6,120,094

[45] Date of Patent: Sep. 19, 2000

[54] ROCKING CHAIR WITH AUTOMATIC LOCKING DEVICE

[76] Inventor: Réal Parent, 2200 rue Louis Félix, C.P. 223, Drummondville, Quebec, Canada, J2B 6V7

[21] Appl. No.: 09/285,445

[22] Filed: Apr. 2, 1999

[51] Int. Cl.[7] ..... A47C 3/03

[52] U.S. Cl. ..... 297/270.1; 297/270.2; 297/270.3; 297/281

[58] Field of Search ..... 297/270.1, 270.2, 297/270.3, 270.4, 281, 282, 280

[56] References Cited

U.S. PATENT DOCUMENTS

| | | | |
|---|---|---|---|
| 2,570,000 | 10/1951 | Lowry | 297/282 |
| 3,826,532 | 7/1974 | Caldemeyer . | |
| 4,707,026 | 11/1987 | Johansson | 297/270.1 |
| 5,294,177 | 3/1994 | Rasnick et al. | 297/270.1 |
| 5,490,715 | 2/1996 | Opsvik | 297/270.1 |

FOREIGN PATENT DOCUMENTS

| | | |
|---|---|---|
| 486858 | 9/1962 | Canada . |
| 812041 | 5/1969 | Canada . |

*Primary Examiner*—Anthony D. Barfield
*Attorney, Agent, or Firm*—F. Martineau; Ls Martineau

[57] ABSTRACT

The rocking chair comprises a base member, a seat support frame rockably mounted thereon, a seat pivoted at its front end to the support frame for limited up and down movement, the weight of a person seated on the seat lowering the seat to a lower limit position against the bias of a spring, and a two part locking device carried by the base member and by the seat and mutually engageable to lock the chair against rocking when the seat is in its upper position and clearing each other when its lower limit position. Therefore, the chair is automatically locked against rocking when a person leaves the seat.

14 Claims, 4 Drawing Sheets

ROCKING CHAIR WITH AUTOMATIC LOCKING DEVICE

FIELD OF THE INVENTION

The present invention relates to a rocking chair and more particularly to a rocking chair with a locking device to prevent rocking.

BACKGROUND OF THE INVENTION

Various types of known rocking chairs are equipped with a locking device to lock the chair against rocking when so desired by the user.

Examples of such rocking chairs are described in U.S. Pat. No. 3,826,532 dated Jul. 30, 1974, entitled Rocking recliner with rocker lock and anti-overturn shock absorber, inventor Daniel F. CALDEMEYER, and in Canadian Patent 486,858 dated Sept. 30, 1962, entitled Locking device for rocking chair, inventor Adelard J. BELISLE.

In the U.S. Patent, the rocking chair is prevented from rocking by operating a hand lever 44 which causes a cam 43 carried by a chair runner 17 to engage the serrations of a rod 47 (see FIGS. 1 and 2).

In the Canadian Patent, operation of a manual lever 32 causes gripping of the plate 20 which locks the seat against rocking.

In both these patents, the two parts of the locking device are carried by the base member and by the seat respectively. Therefore, it is impossible to automatically lock the seat against rocking when a person leaves the chair and to permit rocking when the person becomes seated on the chair.

OBJECTS OF THE PRESENT INVENTION

The general object of the invention is to provide a rocking chair with an automatic locking device which automatically locks the chair against rocking when a person leaves the chair and allows the chair to be rocked when a person sits on the chair.

An important object of the present invention is to provide a rocking chair with an automatic locking device as described, which is of simple and inexpensive construction.

Another object of the present invention is to provide a rocking chair with an automatic locking device controlled by a manual lever having two position, an ON position causing the above-noted automatic unlocking of the chair when a person sits on the same and locking of the chair when a person leaves the chair, and an OFF position allowing the chair to be rocked whether a person is seated or not on the chair.

SUMMARY OF THE INVENTION

The rocking chair of the present invention comprises a base member, a seat support frame rockably mounted thereon, a seat movably mounted on said support frame for limited up and down movement between an upper position and a lower limit position, a stop carried by said seat support frame and engaging said seat in its lower limit position, a biasing device biasing said seat to said upper position, the weight of a person seated on said seat lowering said seat to its lower limit position against the bias of said biasing device, and a two part locking device respectively carried by said base member and by said seat, mutually engageable when said seat is in said upper position and clearing each other when said seat is in said lower limit position, whereby said chair is automatically locked against rocking when a person leaves said seat.

Preferably, the seat is pivoted to the support frame at its front portion and the biasing device includes tension springs attached to the rear portion of said seat and to an upper portion of said seat support frame.

Preferably, the seat support frame forms arm rests disposed above said seat.

Preferably, a back rest upstands from the rear end of said seat.

Preferably, the rocking device for rockably mounting said seat support frame on said base member includes front and rear rocking arms depending from said base and pivotally mounted thereon at upper their ends, a lower portion of said seat support frame being pivotally connected to the lower ends of said rocking arms.

Preferably, said locking device consists of a toothed bar downwardly exposed between said front and rear rocking arms, the other part of said locking device comprising a locking rod engageable with said toothed bar and carried by the lower ends from said front rocking arms and a link supporting said locking rod and attached to said seat near the rear end thereof, said locking rod meshing with said toothed bar when raised by said link and by said seat when in its upper position, said locking rod clearing said toothed bar when said seat is lowered to its lower limit position.

Preferably, said link is length adjustable and consists of a toggle lever, one arm of which is pivotally mounted under said seat and pivoted by a manually actuated lever, the other arm of said rocking lever being pivoted on said locking rod.

Preferably, the other arm of said rocking lever includes a pair of stops limiting the pivotal movement of said toggle lever to a shorter and a longer limit position, in said longer limit position said locking rod clears said toothed bar with said seat in either its upper position or its lower limit position and in said shorter limit position said locking rod clears said toothed bar when said seat is in its lower limit position and meshes said toothed bar when said seat is in its upper position.

BRIEF DESCRIPTION OF THE DRAWINGS

In the annexed drawings, wherein like reference characters indicate like elements throughout.

DETAILED DESCRIPTION OF THE PREFERRED EMBODIMENT

Figure 1:
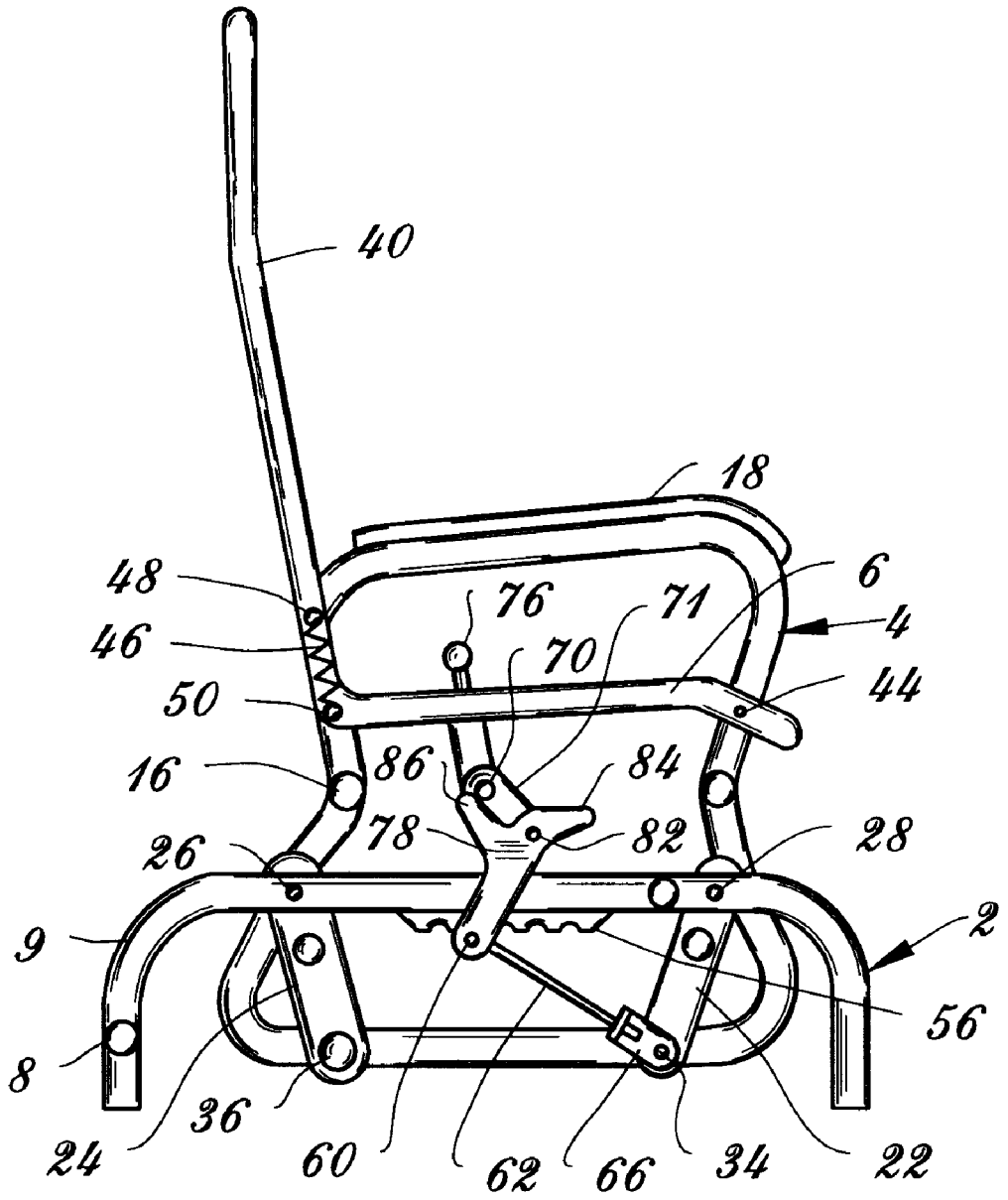
FIGS. 1, 2 and 3 are vertical sections of the rocking chair of the invention in various positions of its component parts.

The chair of the invention comprises a base 2, a seat support frame 4 and a seat 6 carried by the seat support frame 4 which is in turn rockably supported by the base 2.

The base 2 includes a pair of parallel inverted U-shape tubular members joined by cross braces 8 and forming four legs 9 and two upper bight members 10.

The seat support frame 4 is formed of a pair of spaced parallel quadrangular tubular members 14 rigidly interconnected by tubular cross braces 16. The top of each tubular members 14 carries an arm rest 18. Base 2 and seat 6 fit within seat support frame The chair is provided with a rocking mechanism which consists of a pair of front arms 22 and a pair of rear arms 24 which depend by means of top pivots 26 and 28 respectively from the bight members 10 of the base 2. Front and rear arms 22, 24 are respectively interconnected by a cross brace 30 in the form of a tube inserted into a webbed sleeve 32 secured to the inside of the arms.

The lower ends of the front and rear arms 22, 24 are pivotally connected to the lower portion of the seat support frame 4 by means of front and back pivots 34 and 36 respectively.

A back rest 40 is secured to seat 6 by means of braces 42, which can be made adjustable so as to adjust the inclination of the back rest 40 with respect to seat if so desired. The front portion of seat 6 is pivotally connected by pivots 44 to the front of the seat support frame 4, below arm rests 18. The rear portion of seat 6 can pivot upwardly and downwardly about pivots 44 with respect to seat support frame 4. Seat 6 is biased to an upper position under the action of a pair of tension springs 46, located on each side of seat 6, and attached at their upper end to rivets 48 fixed to the back of the quadrangular tubular members 14 and at their lower end to a cross rod 50 joining the back rest 40 to seat 6.

Seat can pivot downwardly against the bias of tension springs 46 to a lower limit position in which it abuts the rear cross brace 16 of the seat support frame 4.

Chair is further provided with a two parts locking device. One part is a toothed bar 56 secured to and exposed under one bight member 10 of base 2. The other part of the locking device includes a U-shape locking rod 58, the bight 60 of which meshes with the toothed bar 56 and the legs 62 of which have threaded outer ends 64, each of which engages a hole in an L-shape strip 66 and is adjustably secured thereto by means of nuts 67. These L-shape strips 66 are pivoted to the lower ends of front rocking arms 22 by means of the pivots 34.

A tension spring 68 is attached at its lower end to the center of bight 60 of U-shape locking rod 58 and at its top end to a cross rod 70 which is rotatably mounted within the lower ends of dependent arms 72 fixed to each side of seat 6. A manual lever 76 is secured to each end of cross rod 70 and is accessible to the chair user. Each one of a pair of Y-shape arms 78 has its lower end rotatably carried at 80 by the bight 60 of U-shape locking rod 58 and is pivoted at its upper portion by a pivot 82 to the lower end of short arms 71 which are secured to cross rod 70. Each Y-shape arm 78 has a front stop 84 and a back stop 86 limiting the pivotal movement of the toggle lever 71, 78; more specifically, in the ON, upward position of the manual lever 76 (see FIGS. 1 and 2), the back stop 86 engages cross rod 70 while in the OFF, forward position of the lever (see FIG. 3), the front stop 84 engages cross rod 70. Tension spring 68 biases toggle lever 71, 78 to either one of its positions which are defined by the ON and OFF positions of lever 76. Toggle lever 71, 78 forms a length adjustable link joining locking rod 58 to seat 6. The ON and OFF positions of lever 76 correspond to the shorter and longer limit position of said link respectively.

Figure 2:
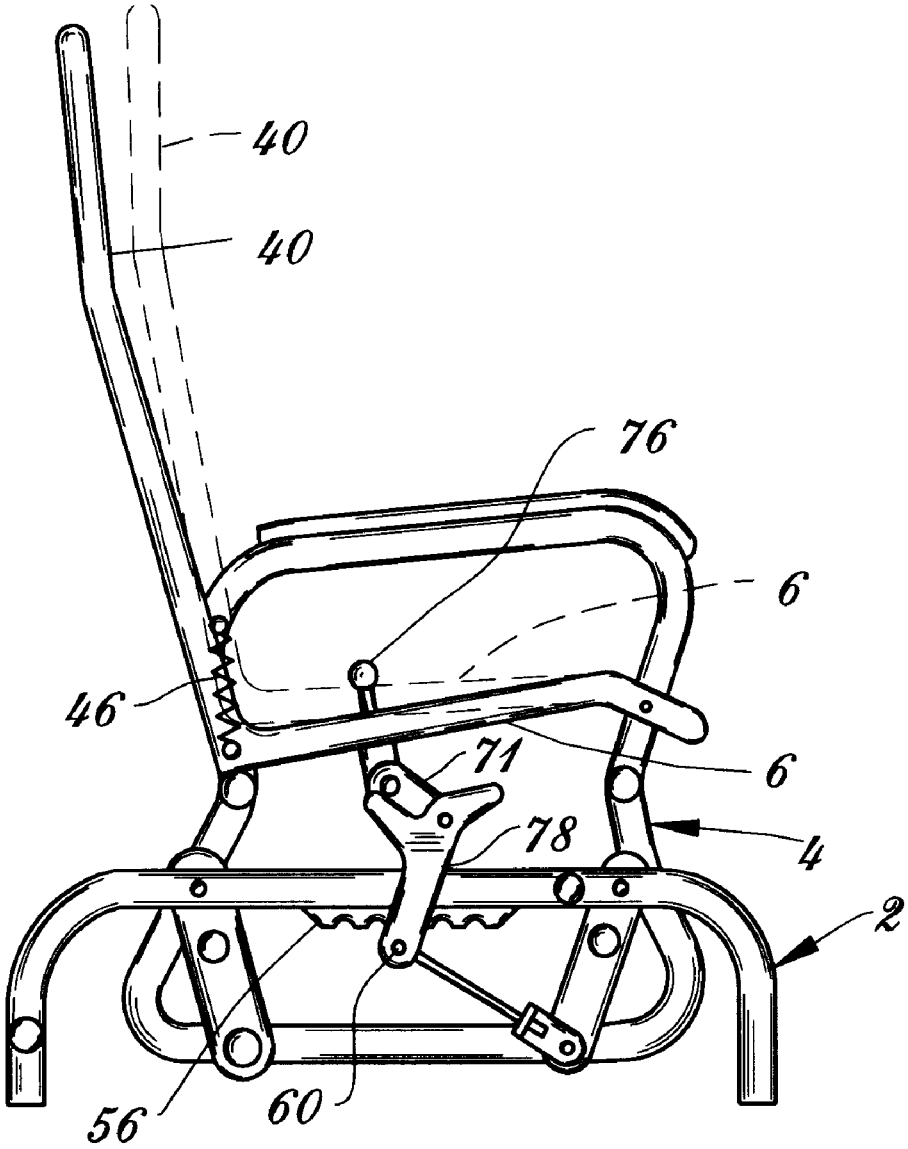

The rocking chair of the invention operates as follows:

Referring to FIGS. 1 and 2, when the manual lever 76 is in ON position; if no person sits on the seat 6, the tension springs 46 bias seat 6 upwardly to an upper limit position in which the bight 60 of the U-shape rod 58 meshes with toothed bar 56 and prevent the chair from rocking.

It is noted that the longitudinal position of the legs 62 of the U-shape locking rod 58 can be adjusted with respect to the L-shape strips 66 to accurately position the bight 60 between the teeth of toothed bar in the ON position of the manual lever 76. This adjustment is normally effected at the chair manufacturing plant.

As soon as a person sits on the seat 6, the latter pivots downwardly about its front pivots 44 against the action of the tension springs 46 until the seat comes to rest on the rear cross brace 16 of the seat support frame 4; as shown in FIG. 2, this causes the bight 60 of the U-shape locking rod 58 to clear the toothed bar 56 allowing the seated person to rock the chair in conventional manner. As soon as the person wishes to leave the chair, she moves forwardly of the seat and starts to stand up using the arm rests 18 as a support; the seat 6 immediately pivots back to its upper limit position causing the locking device to lock the seat support frame 4 and seat against rocking. The person can then further use the now stationary arm rests to completely stand up.

This system has been found to be very convenient for persons having difficulty to stand up from a chair which is free to rock.

Figure 3:
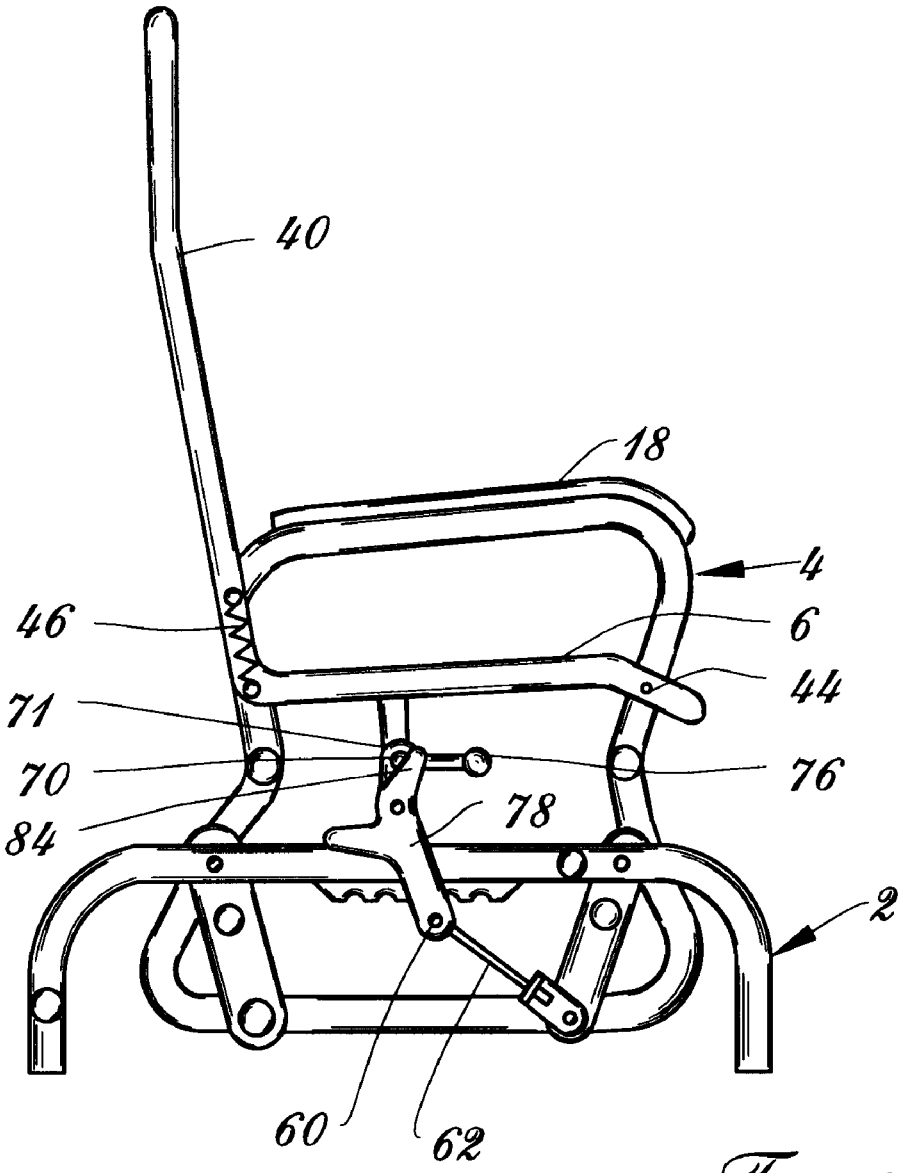
Figure 4:
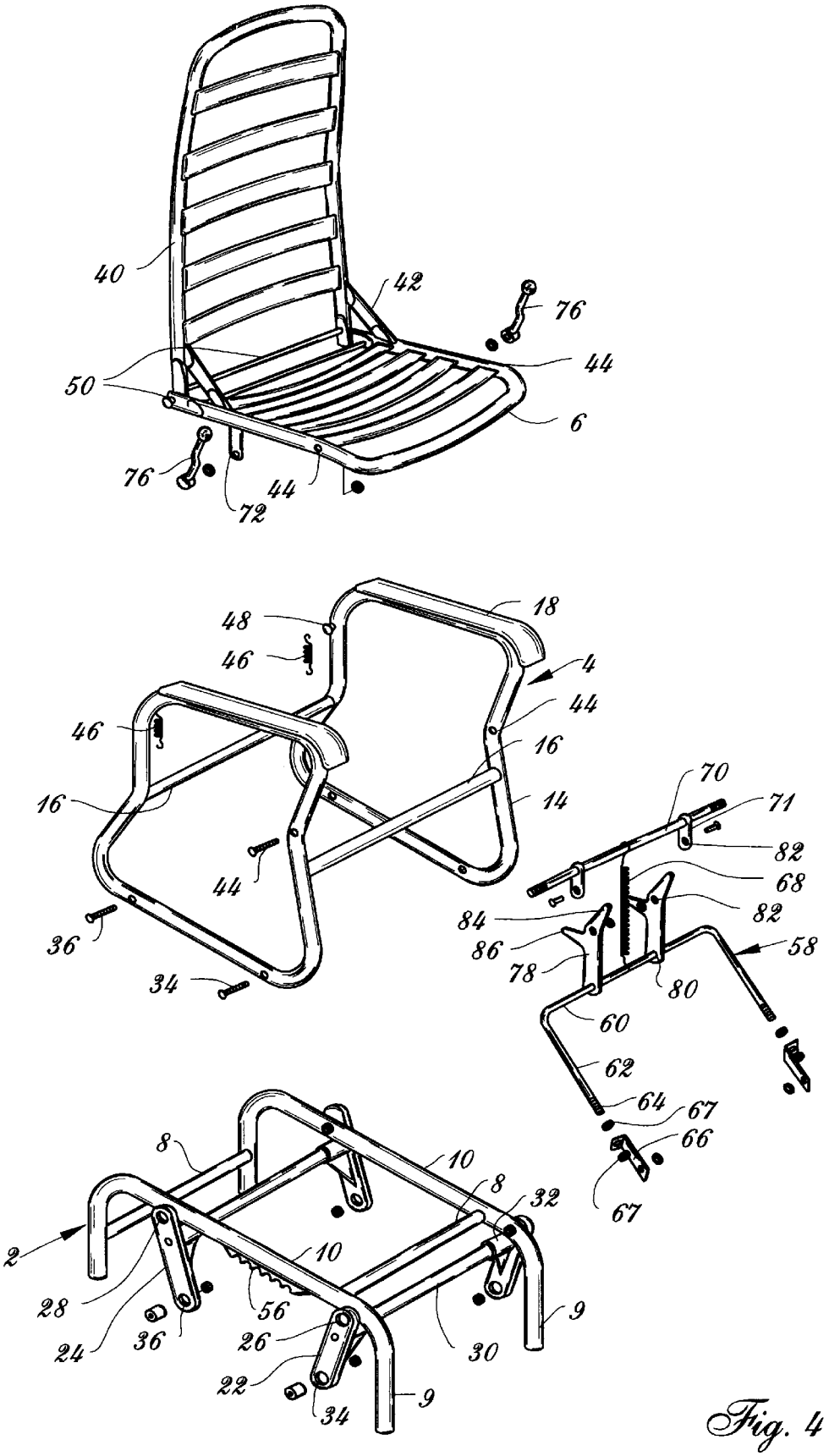
FIG. 4 is an exploded perspective view of the rocking chair.

If so desired, the manual lever can be pivoted to the OFF position as shown in FIG. 3, wherein the locking device is non operational whether the seat is in down or up limit position since the link formed by toggle lever 71, 78 between seat 6 and locking rod 58 is longer than in the ON position of toggle lever 71, 78.

I claim:

1. A rocking chair comprising a base member, a seat support frame rockably mounted thereon, a seat movably mounted on said support frame for limited up and down movement between an upper position and a lower limit position, Said seat having a front and a rear portion, a stop carried by said seat support frame and engaging said seat in its lower limit position, a biasing device biasing said seat to said upper position, where upon the weight of a person seated on said seat lowering said seat to its lower limit position against the bias of said biasing device, and a two part locking device respectively carried by said base member and by said seat, mutually engageable when said seat is in said upper position and clearing each other when said seat is in said lower limit position, whereby said chair is automatically locked against rocking when a person leaves said seat.

2. A rocking chair as defined in claim 1, wherein said seat is pivoted to said support frame at its front portion and said biasing device includes tension springs attached to the rear portion of said seat and to an upper portion of said seat support frame.

3. A rocking chair as defined in claim 2, wherein said seat support frame forms arm rests disposed above said seat.

4. A rocking chair as defined in claim 3, further including a back rest upstanding from the rear portion of said seat.

5. A rocking chair as defined in claim 4, further including a rocking device for rockably mounting said seat support frame on said base member, said rocking device including front and rear rocking arms each having upper and lower ends, said rocking arms depending from said base and pivotally mounted thereon at their upper ends, a lower portion of said seat support frame being pivotally connected to the lower ends of said rocking arms.

6. A rocking chair as defined in claim 1, with said seat support frame having a lower portion wherein one part of said locking device consists of a downwardly exposed toothed bar, the other part of said locking device comprising a locking rod engageable with said toothed bar and carried by the lower portion of said seat support frame and a link supporting said locking rod and attached to said seat near the rear portion thereof said locking rod meshing with said toothed bar when raised by said link and by said seat to its upper position, said locking rod clearing said toothed bar when said seat is lowered to its lower limit position.

7. A rocking chair as defined in claim 6, wherein said link is length adjustable between a shorter and a longer limit position, in said longer limit position said locking rod clears said toothed bar with said seat in either its upper position or its lower limit position and in said shorter limit position said locking rod clears said toothed bar when said seat is in its lower limit position and meshes with said toothed bar when said seat is in its upper position.

8. A rocking chair as defined in claim 6, wherein said link consists of a toggle lever, having one and another lever arm, said one lever arm of which is pivotally mounted under said seat and pivoted by a manually actuated lever, and said another lever arm of said toggle lever being pivoted on said locking rod.

9. A rocking chair as defined in claim 8, wherein said another arm of said toggle lever includes a pair of stops limiting the pivotal movement of said toggle lever to a shorter and a longer limit position, in said longer limit position said locking rod clears said toothed bar with said seat in either its upper position or its lower limit position and in said shorter limit position said locking rod clears said toothed bar when said seat is in its lower limit position and meshes with said toothed bar when said seat is in its upper position.

10. A rocking chair as defined in claim 6, wherein said seat is pivoted to said support frame at its front portion and said biasing device includes tension springs attached to the rear portion of said seat and to an upper portion of said seat support frame.

11. A rocking chair as defined in claim 10, wherein said seat support frame forms arm rests disposed above said seat.

12. A rocking chair as defined in claim 11, further including a back rest upstanding from the rear portion of said seat.

13. A rocking chair as defined in claim 12, further including a rocking device for rockably mounting said seat support frame on said base member, said rocking device including front and rear rocking arms each having upper and lower ends, said rocking arms depending from said base and pivotally mounted thereon at their upper ends, a lower portion of said seat support frame being pivotally connected to the lower ends of said rocking arms.

14. A rocking chair as defined in claim 11, wherein said link consists of a toggle lever, having one and another lever arms, said one lever arm of which is pivotally mounted under said seat and pivoted by a manually actuated lever, and said another lever arm of said toggle lever being pivoted on said locking rod, wherein said another arm of said toggle lever includes a pair of stops limiting the pivotal movement of said toggle lever to a shorter and longer limit position, in said longer limit position said locking rod clears said toothed bar with said seat in either its upper position or its lower limit position and in said shorter limit position said locking rod clears said toothed bar when said seat is in its lower limit position and meshes with said toothed bar when said seat is in its upper position.

* * * * *